US006543170B2

(12) United States Patent
Beretta

(10) Patent No.: US 6,543,170 B2
(45) Date of Patent: Apr. 8, 2003

(54) SAFETY CATCH FOR PISTOLS

(75) Inventor: Ugo Gussalli Beretta, Brescia (IT)

(73) Assignee: Fabbrica d'Armi Pietro Beretta S.p.A. (IT)

( * ) Notice: Subject to any disclaimer, the term of this patent is extended or adjusted under 35 U.S.C. 154(b) by 0 days.

(21) Appl. No.: 09/859,750

(22) Filed: May 17, 2001

(65) Prior Publication Data

US 2002/0088160 A1 Jul. 11, 2002

(30) Foreign Application Priority Data

Jan. 11, 2001 (IT) ..... BS2001A00

(51) Int. Cl.[7] ..... F41A 17/00
(52) U.S. Cl. ..... 42/70.08; 42/70.11
(58) Field of Search ..... 42/70.08, 70.11, 42/66, 70.01

(56) References Cited

U.S. PATENT DOCUMENTS 2,945,316 A * 7/1960 Mulno ..... 42/16
3,673,725 A * 7/1972 Cravener ..... 42/70.01
4,136,475 A * 1/1979 Centille ..... 42/70.11
4,845,870 A * 7/1989 Vernon ..... 42/66
4,967,502 A * 11/1990 Vernon ..... 42/66
5,081,779 A * 1/1992 Pack ..... 42/70.11
5,235,763 A * 8/1993 Nosler et al. ..... 42/66
5,361,525 A * 11/1994 Bowes ..... 42/70.06
5,581,927 A 12/1996 Meller
5,671,560 A * 9/1997 Meller ..... 42/66
6,205,694 B1 * 3/2001 Davis, Sr. ..... 42/22

* cited by examiner

*Primary Examiner*—Michael J. Carone
*Assistant Examiner*—M. Thomson
(74) *Attorney, Agent, or Firm*—McGlew and Tuttle, P.C.

(57) ABSTRACT

A safety catch is provided for firearms, such as pistols and revolvers, having a firing hammer (11) with a thrust spring (13) associated with a spring-holder rod (14) with a free end (16) of a noncircular cross section. The safety catch includes a safety pin (19), which is aligned with the free end of the spring holder (14) and is capable of axial, rotary translatory movements that can be controlled by a defined contour key (20) for a longitudinal blocking of the spring-holder rod (14), so as to prevent the arming and the action of the firing hammer when it is released and inhibits the functioning of the gun in the absence of the key.

12 Claims, 5 Drawing Sheets

SAFETY CATCH FOR PISTOLS

FIELD OF THE INVENTION

The present invention pertains generally to firearms, and more specifically to a safety catch intended for selectively preventing the action of the firing hammer in firearms, such as pistols and revolvers.

BACKGROUND OF THE INVENTION

In general, the firing hammer in pistols rotates on an axis between an armed position and a released, percussion position. The firing hammer is stressed by a spring that is associated and guided with a spring-holder rod. This spring-holder rod has an end connected to the firing hammer and an opposite, free end. The spring-holder rod is capable of longitudinal movements, and follows the rotating movements of the firing hammer between the armed and released positions.

When the firing hammer is armed, the spring is compressed between two rabbets, of which one can be moved with the spring-holder rod and the other is stationary in the stock of the gun. As soon as the firing hammer is released from the armed position, the spring reacts by rotating the said firing hammer for its percussion action for the firing of ammunition.

For the purpose of the safety of such guns, when they are not used or remain unattended, there is a need for providing them with devices that are able to selectively inhibit their action and particularly the action of the firing hammer on the firing pin. This need has been felt for some time. This has the objectives of preventing any accidental functioning of the gun, inhibiting its use by children or inexperienced people and, in other words, preventing an unintentional use of the gun as well as an intentional use of same by those who may have stolen it or may not be its owner.

In this regard, various safety catches have already been proposed, including systems, which are aimed at preventing the firing hammer from being able to reach and strike the firing pin. More specifically such devices are intended to prevent the movement of the spring-holder rod and, therefore, the loading of the spring of the firing hammer, once the firing hammer has been released from the stop position. Such devices that may be activated and deactivated only by means of a personalized access key, have already been proposed An example of a safety catch for pistols has become known from U.S. Pat. No. 5,081,779, in which is described the presence of a rotating cam, which is associated with the spring-holder rod of the firing hammer and is selectively moved by a lock block controllable with a key. The cam may be rotated and stopped in a position that is inactive and does not affect the normal arming and releasing of the firing hammer and a usual use of the gun. For putting on the safety catch, the cam is rotated into an active position, in which it has to intercept and block the spring-holder rod, therefore preventing the longitudinal movement of same, the arming of the firing hammer once it has been released, and as a consequence, the use of the gun if the appropriate key is not available for activating the lock block.

The rotating cam and the lock block can be mounted in the stock of the gun according to an orientation that is transverse or longitudinal to the spring-holder rod of the firing hammer.

Another safety catch for pistols has become known from U.S. Pat. No. 5,581,927 and comprises a lock block with a control key. This device is arranged such that the lock block, when activated with its own key, interferes with the action of an essential functional component of the gun, thus preventing the functioning of the gun. In its mode of application the functional component with which such safety catch is intended to interact is the spring of the firing hammer, so as to inhibit the arming of same.

SUMMARY AND OBJECTS OF THE INVENTION

One object of the present invention is to provide a safety catch for pistols and the like which is intended to interact with the spring-holder rod of the firing hammer, but is configured differently from the prior-art devices so as to be able to be activated and deactivated by means of its rotating, traverse movement with a key.

Another object of the present invention is to provide a safety catch that is able to positively block the firing hammer of a pistol or the like in the position with the firing hammer brought down, i.e., released, without the possibility of rotating it and arming it.

According to the invention, a safety catch for firearms such as pistols and revolvers is provided. The firearm has a firing hammer rotating on an axis between a released position and an armed position against the action of a thrust spring. The spring is associated and guided with a spring-holder rod. The spring-holder rod has an end connected eccentrically to the firing hammer and an opposite, free end of a noncircular cross section. A safety body defining a housing is provided to be fixed to a part of the stock of the gun in association with a free end of the spring-holder rod. A safety pin is mounted in the housing of the safety body in an arrangement that is aligned with the lower end of the spring holder and is capable of axial, rotary translatory movements. A defined contour (mapped) key (which may have a shape recorded and maintained in a data base) is provided for access and coupling to a part of the safety pin for the rotary translatory movements of the safety pin between a passive, lowered position, which does not affect the spring-holder rod for a normal functioning of the gun, and an active, raised position for the longitudinal blocking of the spring-holder rod for blocking the firing hammer in the released position and inhibiting the functioning of the gun.

The safety pin may have a defined contour (coordinated contour of defined shape) terminal portion for coupling with the control defined contour key and is stressed in the axial direction by a safety spring acting in the manner of normally maintaining the safety pin in the passive, lowered position. The safety pin may be mounted in the housing of the safety body with the possibility of rotating by a certain angle around its geometric axis, and having said lateral cam portions, which interact with the fixed companion cams which are provided in the housing for a translation of the safety pin between the passive and active positions simultaneously with the rotation of the safety pin with the defined contour key. The safety pin may have a top wall turned towards the lower end of the spring-holder rod. In the top wall there may be provided a hole having a cross section equal to that of the lower end of the spring-holder rod, the hole being aligned and coinciding with the lower end of the spring holder only when the safety pin is in the passive, lowered position, the hole being misaligned with respect to the rod for the interception of same by the safety pin when this is in the active, raised position.

A burglar-proof reinforcement part may be provided in the safety body, around and at the level of the defined contour portion. The safety body may be fixed to the stock of the gun and the safety pin may be held in the body with a safety pin, which can be removed only when the safety pin is in the passive position. The safety body may be fixed to the stock of the gun and the safety pin may be held in the safety body with a sphere, which makes possible disassembly only when the safety pin is in the passive position. The sphere may be mounted radially in the safety body, interfering with the stock of the gun when the safety pin is in the active position.

A rotatable, terminal plug may be provided for preventing access to and grasping of the pin with working tools other than the key. An antidrill conical head may be applied to the safety pin on the side of the defined contour portion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
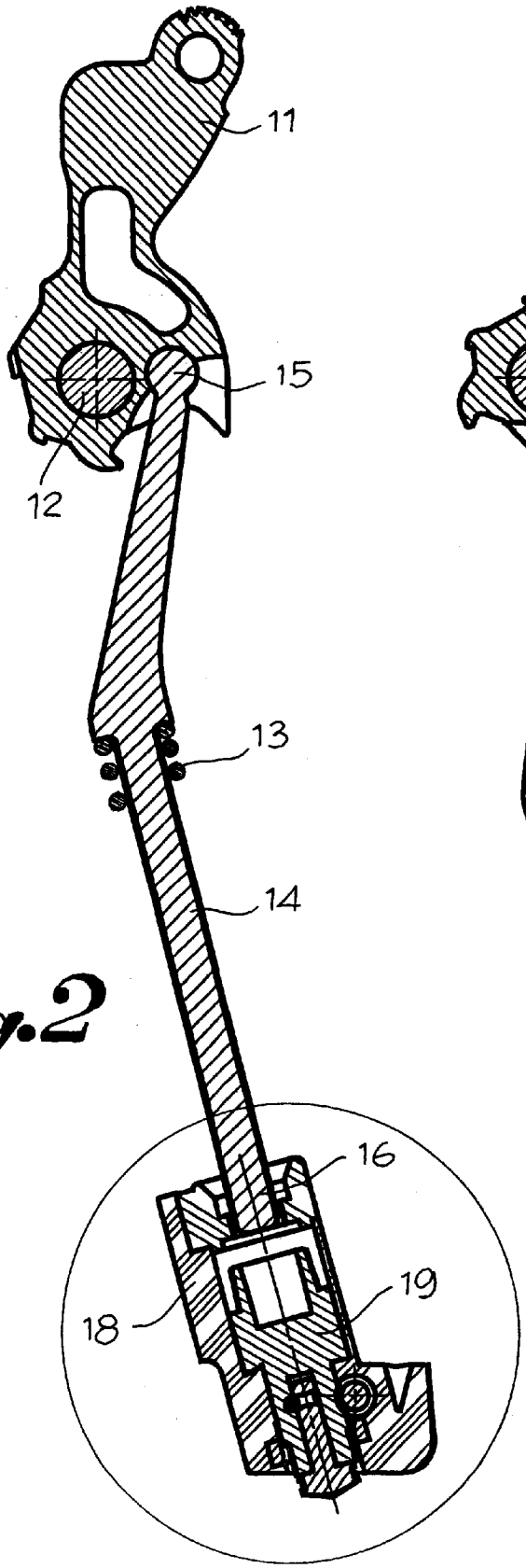
FIG. 2 is a sectional view of the device not on safety with the firing hammer in the released position.
Figure 3:
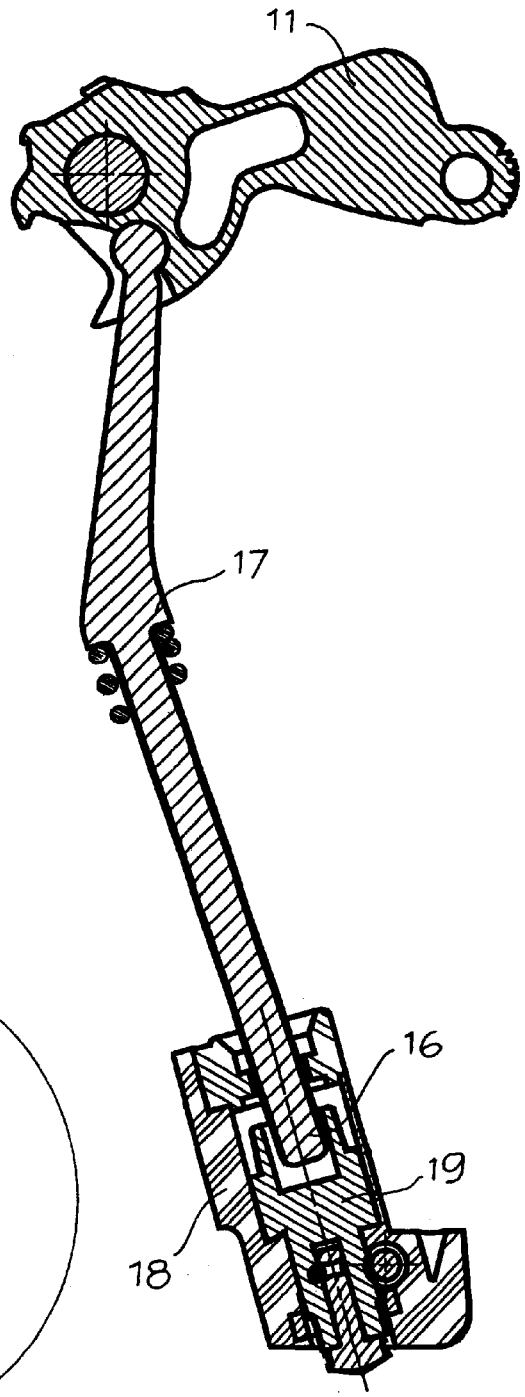
FIG. 3 is a sectional view of the device not on safety with the firing hammer in the armed position.

Referring to the drawings in particular, a firearm such as a pistol or the like has a usual firing hammer 11 that rotates on an axis 12 between a released position (FIG. 2) and an armed position (FIG. 3) against the action of a thrust spring 13 associated and guided with a spring-holder rod 14.

This spring-holder rod 14 has an end 15 connected eccentrically to the firing hammer 11 and an opposite, free end 16, having a polygonal and noncircular cross section.

The safety catch according to the present invention is associated with this free end 16 of the spring-holder rod 14 and acts as a support for a lower end of the thrust spring 13, whose upper end rests against a shoulder 17 provided along the spring-holder rod.

The safety catch essentially comprises a safety body 18 and a safety pin 19 that are aligned with the spring-holder rod 14, and a defined contour/control key 20 for controlling the safety pin.

The safety body 18 delimits, axially, a housing having a first, lower portion 21 having a first diameter and open towards the bottom, and a second, upper portion 22 having a larger diameter and obstructed towards the top by a safety plug 23, which has an opening 24, in which the free end 16 of the spring-holder rod 14 passes.

The safety pin 19 is arranged in the housing with the possibility of rotating 90° about its own geometric axis and of translating axially. The safety pin has a collar 25, which is coupled to the first portion 21 and a head 26 at the level of the second portion 22 of the housing in the safety body 18.

Figure 11:
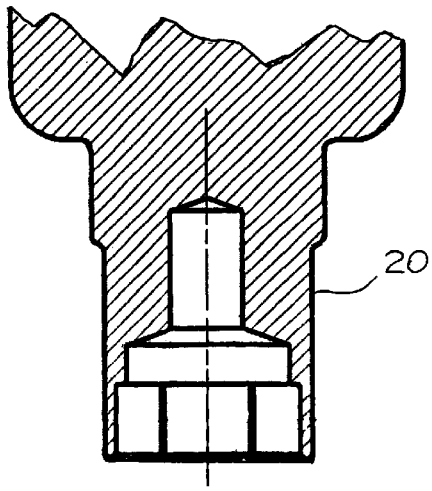
FIG. 11 is a sectional view of a control key.
Figure 12:
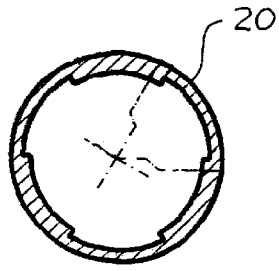
FIG. 12 is an end view of a control key.

The collar 25 of the safety pin 19 ends with a defined contour portion 27 that is turned and exposed towards the bottom and is accessible with the contour/control key 20 which will be shaped correspondingly (FIGS. 11 and 12). As for the part of the defined contour portion 27, a terminal plug 28 having a shank 29 inserted into a hole and supported there by means of an elastic pin 30 may be applied to the safety pin 19. The terminal plug 28 is rotatable, prevents the safety pin from rotating with a collet or other means and also has an antidrill conical head. A reinforcement ring 19' or, at any rate, a burglarproof part can be provided in the safety body, around and at the level of the defined contour portion 27 of the safety pin 19.

Figure 6:
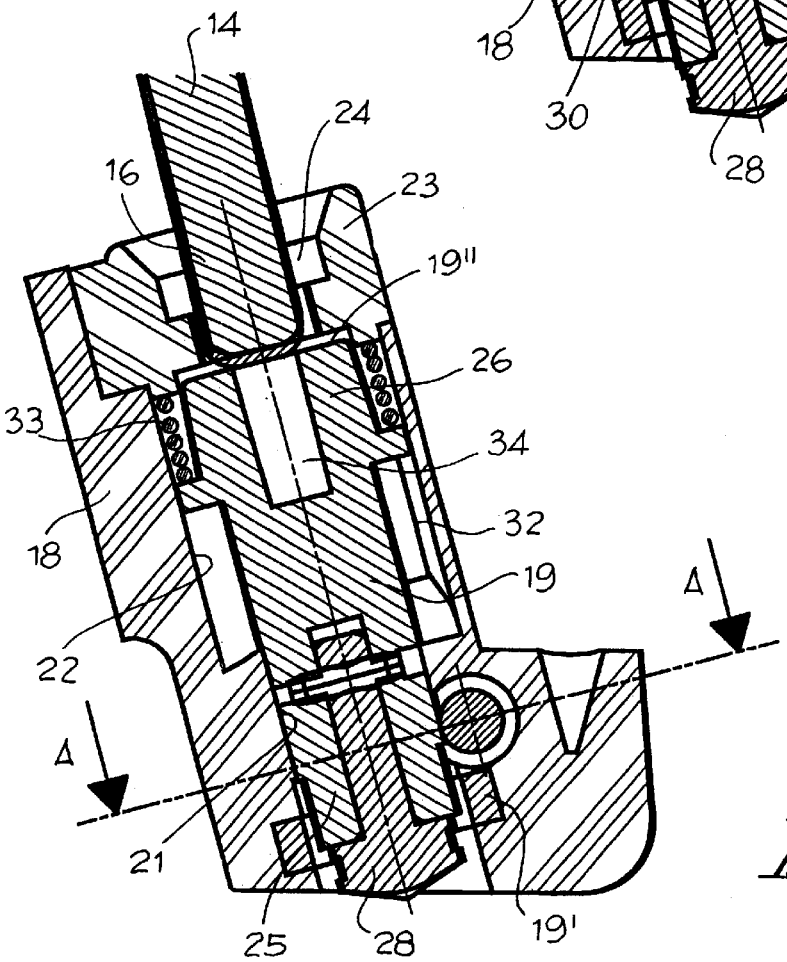
FIG. 6 is an enlarged view of the part circled in FIG. 5.
Figure 6A:
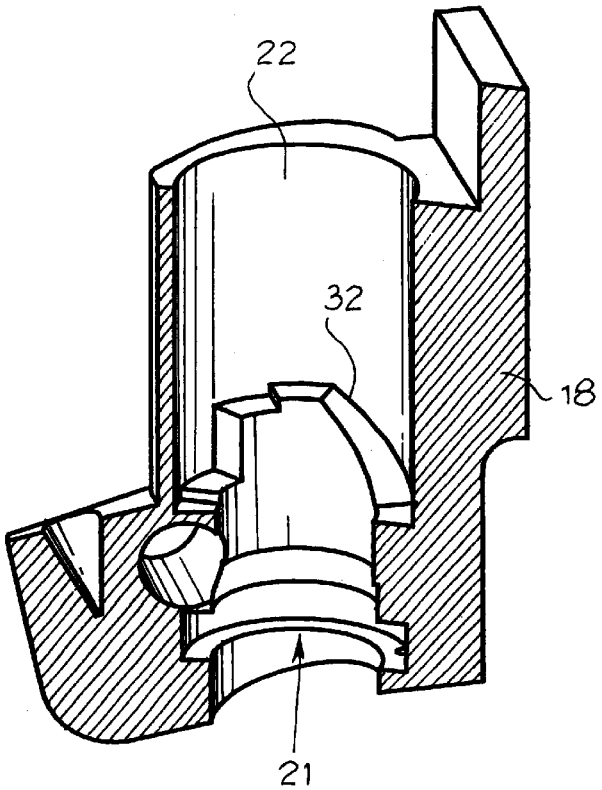
FIG. 6*a* is a perspective sectional view of the safety body for demonstrating its internal companion cams.
Figure 7:
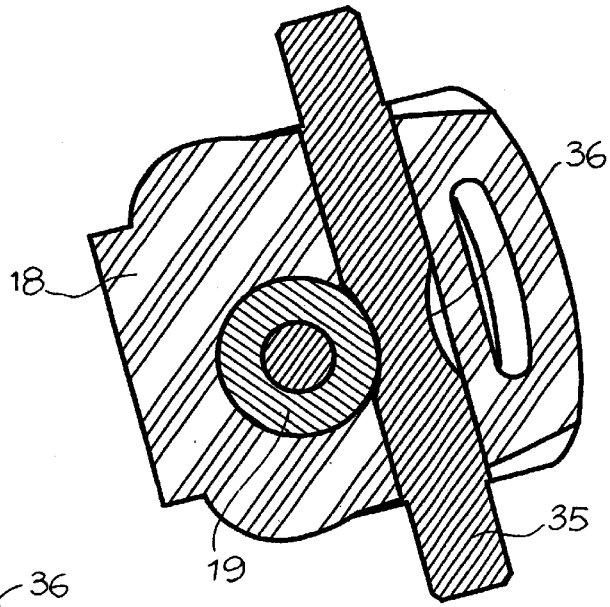
FIG. 7 is a cross sectional view taken along line A—A of FIG. 4 of an anti-extraction pin system for the device in the stopped position.

Laterally, the head 26 of the safety pin 19 has cam portions 31 joined with companion cams 32 (FIG. 6*a*) provided on the internal surface of the second portion 22 of the housing in the safety body and configured such that an axial translation of the safety pin between a passive, lowered position, in which it does not affect the functioning of the gun, and an active, raised position, in which it inhibits the action of the firing hammer and thus of the gun, corresponds with the rotation of the safety pin caused by the key 20.

Between the safety plug 23 and the head 26 of the safety pin 19 is mounted a safety spring 33, which is intended to bring back and normally maintain the safety pin in its lowered, i.e., passive position.

Figure 9:
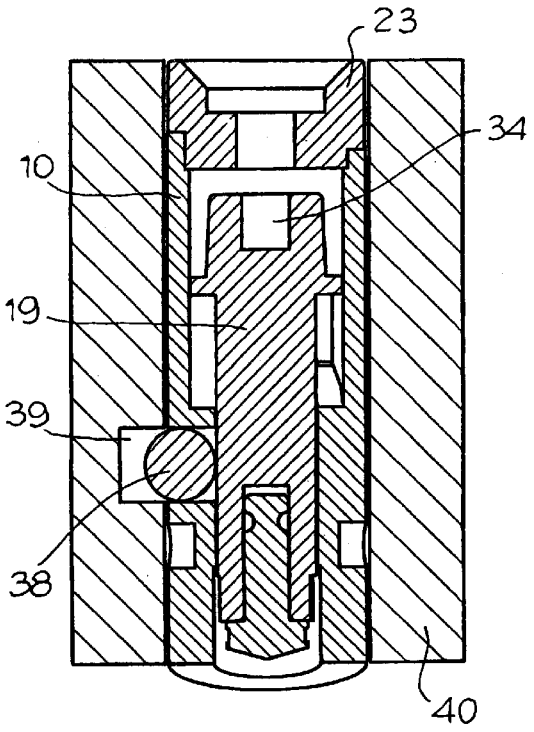
FIG. 9 is a longitudinal sectional view of an anti-extraction sphere system with a device in the restrained position for the extraction.
Figure 10:
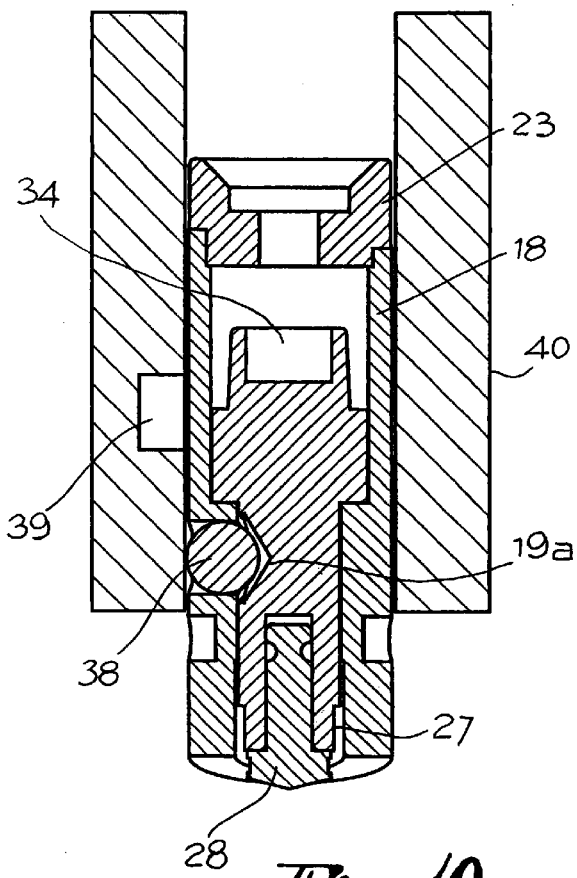
FIG. 10 is a longitudinal sectional view of an anti-extraction sphere system with a device in the released positions for the extraction.

The safety pin 19 is held axially in the safety body 18 by means of a tangential safety/release pin or member 35, which may also be used to restrain the safety body and therefore the device to the stock of the gun indicated by 40 in FIGS. 9 and 10.

Figure 8:
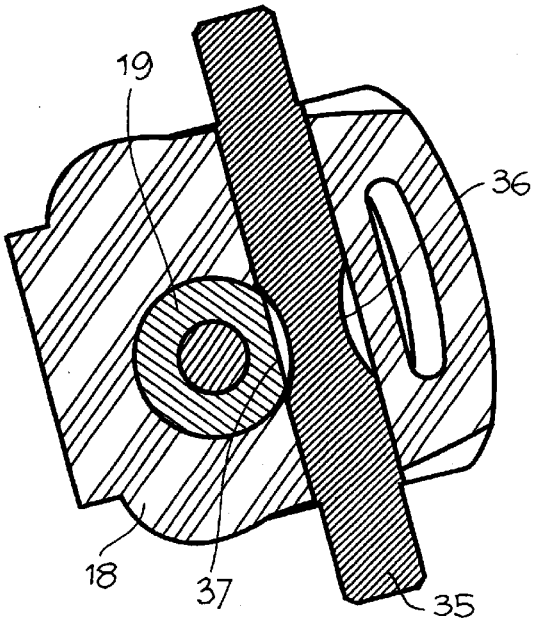
FIG. 8 is a cross sectional view taken along line A—A of FIG. 4 of an anti-extraction pin system for the device in the released position.

The safety pin 35 has an intermediate tapered section 36 and the safety pin 19 has a lateral notch 37, which make possible the releasing and disassembly of the safety catch only when they are at the same level turned towards one another, a condition which occurs when the safety pin is in the passive position (FIG. 8).

Instead of a safety pin, a safety sphere 38, as shown in FIGS. 9 and 10, may be provided for holding the safety body 18 in the stock 40 of the gun and the safety pin 19 in the body. As shown, the sphere 38 is arranged radially in a hole provided in the safety body, and when the safety pin 19 is advanced into the active position, the sphere has to engage the safety body 18 and the stock 40 at the same time at the level of a hole 39 provided inside same stock (FIG. 9), thus preventing the extraction of the safety catch.

When the safety pin 19 is moved back into the passive position, the sphere 38 is at the level of, and may again enter into, a notch 19*a* provided on one side of the safety pin, therefore permitting only the extraction of the device (FIG. 10).

At its top 19", the safety pin 19 has a hole 34, having a cross section equal to that of the free lower end of the spring-holder rod 14. This hole 34 is oriented and coincides with the lower end of the spring-holder rod 14 only if the safety pin 19 is in its passive position.

Figure 4:
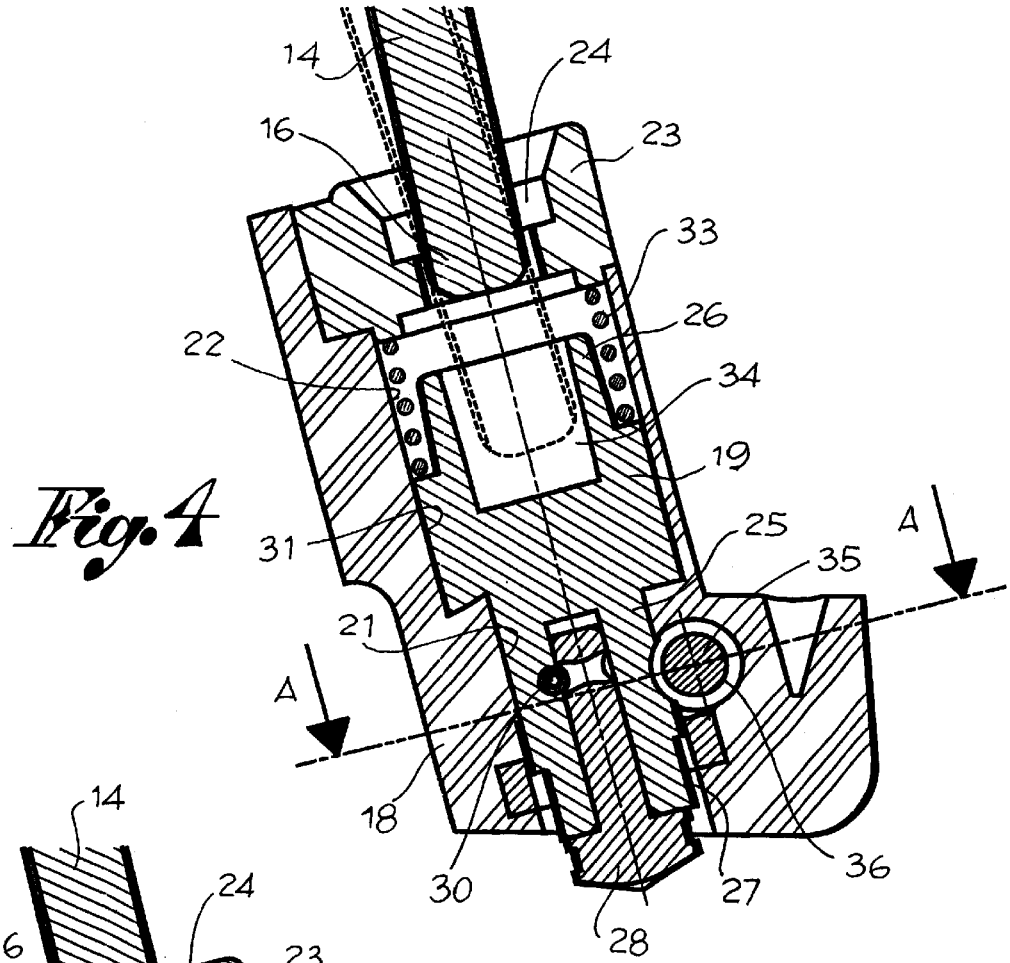
FIG. 4 is an enlarged view of the part circled in FIG. 2.

Therefore (FIGS. 2–4), the spring-holder rod 14 is free to slide axially, being able to enter into the hole 34, and make possible the rotation of the firing hammer from the released position to the armed position, and vice versa, for the normal use of the gun.

Figure 5:
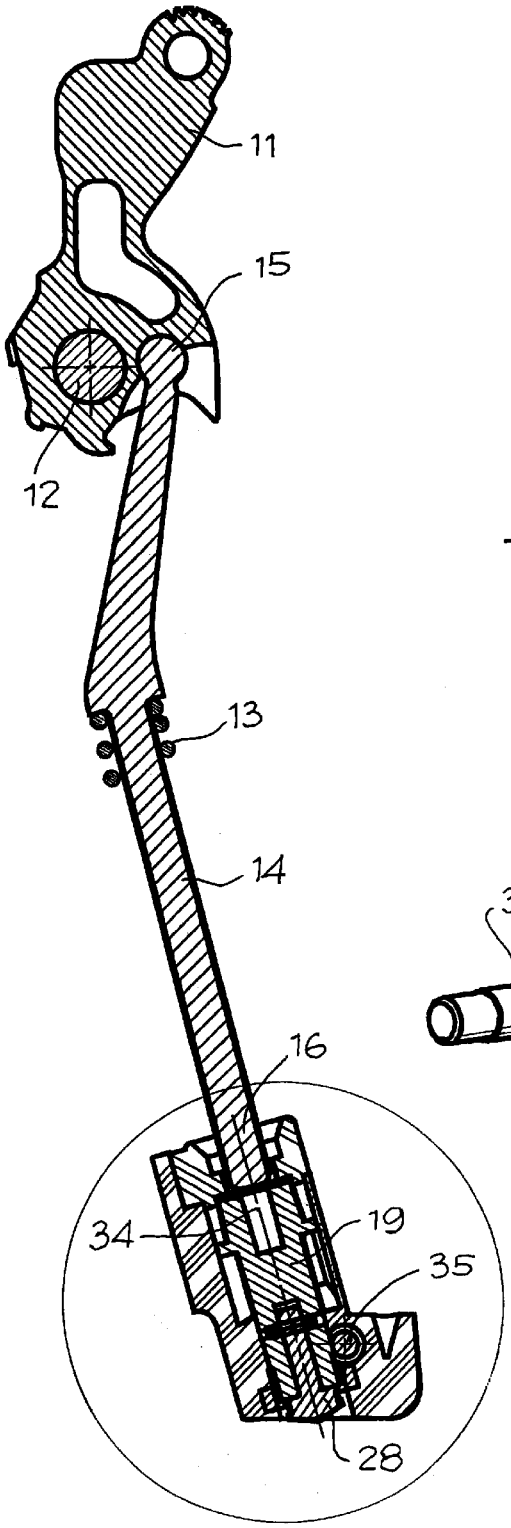
FIG. 5 is a sectional view of the device on safety with the firing hammer lowered and blocked.
Figure 1:
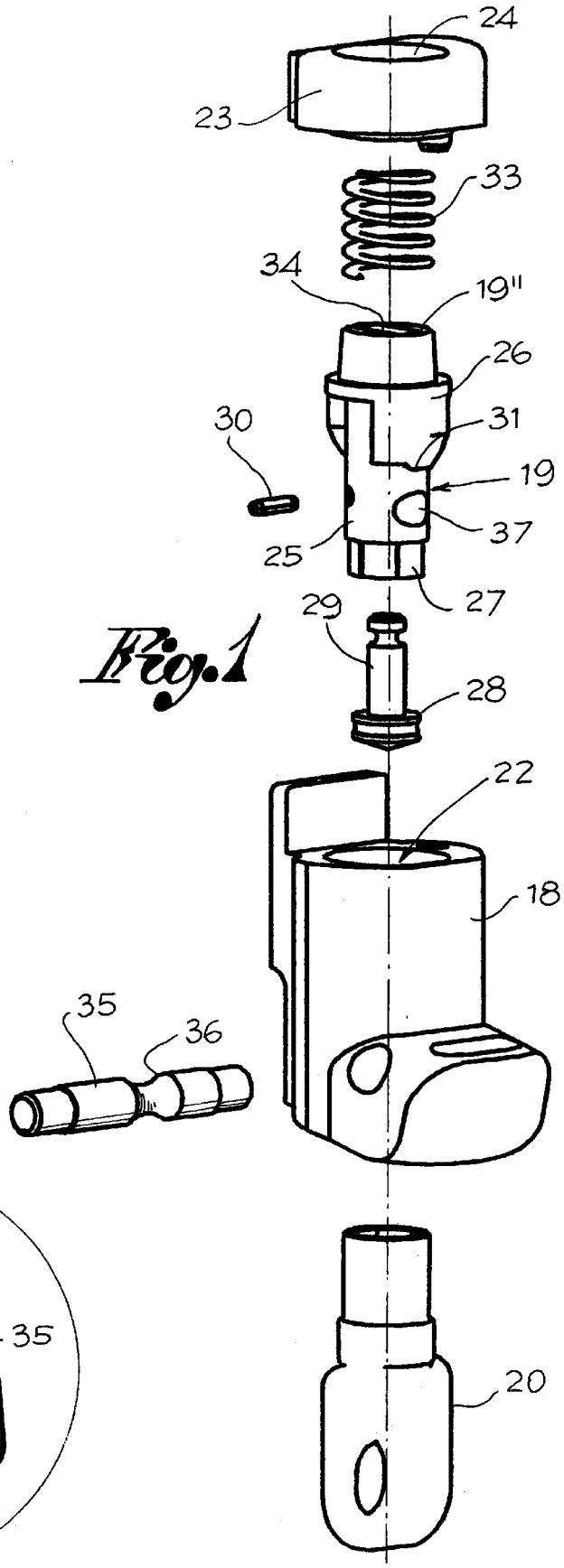
FIG. 1 is an exploded view of the components of the safety catch.

To inhibit the use of the gun, the firing hammer is blocked by means of the safety catch by using the key 20. Once the firing hammer is released or has just been released (FIGS. 5 and 6), the free end of the spring-holder rod 14 moves away from the safety pin 19. Therefore, the safety pin 19 is accessed with the key 20 and it is made to rotate. With this rotation, the top hole 34 of the safety pin is misaligned or is arranged transversely to the lower end of the spring-holder rod 14, and at the same time, the safety pin translates upwards into the active position, which is forced by to the contact of its lateral cams 31 with the companion cams 32. Thus, the head 19"of the safety pin 19 will be brought closer to the lower end of the spring-holder rod, intercepting it, and preventing any longitudinal movement of same and consequently the rotation of the firing hammer to the armed position.

The restoration of the condition of normal functioning of the gun shall therefore be possible only by having the key for rotary translating the safety pin backwards into its passive position.

While a specific embodiment of the invention has been shown and described in detail to illustrate the application of the principles of the invention, it will be understood that the invention may be embodied otherwise without departing from such principles.

What is claimed is:

1. A safety catch for firearms such as pistols and revolvers having a firing hammer rotating on an axis between a released position and an armed position against the action of a thrust spring, the thrust spring being associated and guided with a spring-holder rod, the spring-holder rod having an end connected eccentrically to the firing hammer and an opposite free end of a noncircular cross section, the safety catch comprising:

a safety body fixable to a part of a stock of the firearm in association with said free end of the spring-holder rod, said safety body defining a housing;

a safety pin mounted in a housing of the safety body in an arrangement that is aligned with a lower end of the spring holder rod and is capable of axial, rotary translatory movements; and a defined contour key for access and coupling to a part of the safety pin for the rotary translatory movements of the safety pin between a passive, lowered position, which does not affect the spring-holder rod for a normal functioning of the gun, and an active, raised position for the longitudinal blocking of the spring-holder rod for blocking the firing hammer in the released position and inhibiting the functioning of the gun;

the safety pin has a defined contour terminal portion for coupling with a control defined contour key, said safety pin being stressed in an axial direction by a safety spring acting in the manner of normally maintaining the safety pin in the passive, lowered position.

2. A safety catch in accordance with claim 1, wherein the safety pin is mounted in said housing of said safety body providing the possibility of the safety pin rotating by a certain angle around a geometric axis, and having lateral cam portions interacting with fixed companion cams, sad fixed companion cams being provided in said housing for a translation of said safety pin between the passive and active positions simultaneously with the rotation of the safety pin with the defined contour key.

3. A safety catch in accordance with claim 1, wherein said safety pin has a top wall turned towards the lower end of said spring-holder rod, and in which in the top wall there is provided a hole having a cross section equal to that of the lower end of the spring-holder rod, said hole being aligned and coinciding with a lower end of the spring holder only when the safety pin is in the passive, lowered position, said hole being misaligned with respect to the rod for the interception of same by the safety pin when said safety pin is in the active, raised position.

4. A safety catch in accordance with claim 1, wherein a burglar-proof reinforcement part is provided in a safety body, around and at the level of said defined contour portion.

5. A safety catch in accordance with claim 1, wherein the safety body is fixed to the stock of the firearm and the safety pin is held in the body, said safety pin being removable only when the safety pin is in the passive position.

6. A safety catch for firearms such as pistols and revolvers having a firing hammer rotating on an axis between a released position and an armed position against the action of a thrust spring, the thrust spring being associated and guided with a spring-holder rod, the spring-holder rod having an end connected eccentrically to the firing hammer and an opposite free end of a noncircular cross section, the safety catch comprising:

a safety body fixable to a part of a stock of the firearm in association with said free end of the spring-holder rod, said safety body defining a housing;

a safety pin mounted in a housing of the safety body in an arrangement that is aligned with a lower end of the spring holder rod and is capable of axial, rotary translatory movements; and a defined contour key for access and coupling to a part of the safety pin for the rotary translatory movements of the safety pin between a passive, lowered position, which does not affect the spring-holder rod for a normal functioning of the gun, and an active, raised position for the longitudinal blocking of the spring-holder rod for blocking the firing hammer in the released position and inhibiting the functioning of the gun;

said safety pin has a top wall turned towards the lower end of said spring-holder rod, and in which in the top wall there is provided a hole having a cross section equal to that of the lower end of the spring-holder rod, said hole being aligned and coinciding with a lower end of the spring holder only when the safety pin is in the passive, lowered position, said hole being misaligned with respect to the rod for the interception of same by the safety pin when said safety pin is in the active, raised position.

7. A firearm comprising:

a stock;

a firing hammer rotatable on said stock between a released position and an armed position;

a thrust spring biasing said firing hammer toward said released position;

a spring-holder rod guiding said thrust spring, said spring-holder rod having a first end in contact with said firing hammer, said spring-holder rod having an opposite second end;

a safety body fixable in said stock and defining a bore;

a safety pin mounted in said bore of the safety body and contactable with said second end of said spring-holder rod, said safety pin being movable between a passive and an active position, said active position arranging said spring-holder rod to hold said firing hammer fixed, said passive position allowing movement of said firing hammer between said released position and said armed position;

a key engageable with said safety pin for moving said safety pin between said active and said passive positions;

a release member movable in said stock between a first position and a second position, said release member engaging said safety pin with said stock in said first position, said release member disengaging said stock and said safety pin in said second position, said release member and said safety pin being shaped to fix said release member in said first position when said safety pin is in said active position.

8. A gun device in accordance with claim 7, wherein: said release member includes a sphere, said safety body being fixed to the stock of the gun and said safety pin being held in said safety body with said sphere to make possible disassembly only when the safety pin is in the passive position, said sphere being mounted radially in the safety body and interfering with said stock when the safety pin is in the active position.

9. A gun device in accordance with claim 7, wherein said safety pin has a defined contour portion and a rotatable terminal plug for preventing access to and grasping of the safety pin with working tools other than a key corresponding to said defined contour portion, said plug being having an antidrill conical head, said plug being Please replace claim wherein said safety pin has a defined contour portion and a rotatable terminal plug for preventing access to and grasping of the safety pin with working tools other than a key corresponding to said defined contour portion, said plug being having an antidrill conical head, said plug being applied to said safety pin on a side of said defined contour portion.

10. A firearm in accordance with claim 7, wherein:

said release member is one of a pin and a sphere.

11. A firearm in accordance with claim 7, wherein:

said safety pin has a safety end contactable with said second end of said spring-rod, said safety end defines a safety hole, said safety hole and said second end of said rod being shaped and arranged to have said second end move into said safety hole in said passive position of said safety pin, and to block said second end from moving into said safety hole in said active position of said safety pin.

12. A firearm in accordance with claim 7, further comprising:

a plug rotatable mounted in said safety pin, said plug having an antidrill conical head.

* * * * *

UNITED STATES PATENT AND TRADEMARK OFFICE

CERTIFICATE OF CORRECTION

PATENT NO. : 6,543,170 B2
DATED : April 8, 2003
INVENTOR(S) : Ugo Gussalli Beretta It is certified that error appears in the above-identified patent and that said Letters Patent is hereby corrected as shown below:

Title page,
Item [30], should read:
-- [30] Foreign Application Priority Data
Jan. 11, 2001 (IT) .....BS2001A000001. --

Signed and Sealed this

Eighteenth Day of November, 2003

JAMES E. ROGAN
*Director of the United States Patent and Trademark Office*